United States Patent [19]

Brown

[11] Patent Number: 4,500,043

[45] Date of Patent: Feb. 19, 1985

[54] LOW TENSION WINDING APPARATUS

[75] Inventor: Patrick C. Brown, Painted Post, N.Y.

[73] Assignee: Corning Glass Works, Corning, N.Y.

[21] Appl. No.: 519,063

[22] Filed: Aug. 1, 1983

[51] Int. Cl.[3] ..... B65H 59/38

[52] U.S. Cl. ..... 242/45; 226/45; 242/75.52

[58] Field of Search ..... 242/45, 75.52, 75.51; 226/45, 44, 24, 42, 43

[56] References Cited

U.S. PATENT DOCUMENTS

| | | | |
|---|---|---|---|
| 3,277,305 | 11/1960 | Anderman, Jr. . | |
| 3,908,920 | 9/1975 | Hermanns | 242/45 |
| 4,195,791 | 4/1980 | Frazee, Jr. . | |
| 4,297,586 | 10/1981 | Rogers . | |
| 4,384,665 | 5/1983 | Waddington . | |

FOREIGN PATENT DOCUMENTS

| | | | |
|---|---|---|---|
| 9751 | 7/1962 | Japan | 242/45 |
| 893350 | 4/1962 | United Kingdom | 226/45 |

*Primary Examiner*—Stanley N. Gilreath
*Attorney, Agent, or Firm*—W. J. Simmons, Jr.

[57] ABSTRACT

A plurality of photo sensitive devices arranged in vertical orientation monitors the sag of a loop of optical fiber extending between a feed capstan and a take-up spool. Each detector is connected to a respective switching circuit which, when activated by the presence of the fiber adjacent to its associated detector, generates a unique voltage. The switching circuits are connected to a motor control circuit by a sample and hold circuit which supplies to the motor control circuit a voltage proportional to the voltage generated by the most recently activated switching circuit. The speed of the motor driving the take-up spool is thus adjusted to cause the fiber catenary to return to a predetermined position.

5 Claims, 2 Drawing Figures

LOW TENSION WINDING APPARATUS

BACKGROUND OF THE INVENTION

During the fabrication of an optical fiber the drawn fiber is often initially wound on a temporary retaining spool. In a separate operation the fiber is screen tested for strength and wound at low tension onto a shipping spool. Such low tension winding may be accomplished by feeding the fiber from a first location to a take-up spool located at a remote location in such a manner that a free hanging fiber catenary exists between the feed apparatus and take-up spool. This technique requires that a relationship exist between the velocities of the fiber feed apparatus and take-up spool so that an initial sag placed in the fiber between these two devices does not substantially change during the rewinding operation.

A fiber catenary controller is disclosed in U.S. Pat. No. 4,195,791. The apparatus disclosed in that patent comprises a closed circuit TV camera for monitoring the sag of a loop of optical fiber extending between a fiber drawing mechanism and a take-up spool. The camera is rotated 90° about its optical axis to vertically scan the plane of the fiber catenary and forward the video scan signal to a video signal processor. The processor continuously determines the displacement of the lowest point of the loop from an optimum position and generates an electrical signal proportional thereto. The signal is forwarded to a spool motor to adjust the speed of the take-up spool to cause the fiber catenary to return to a predetermined position. While being capable of accurately maintaining the position of a fiber catenary, such an apparatus is very costly.

SUMMARY OF THE INVENTION

Briefly, the present invention relates to apparatus for automatically controlling the sag depth of a catenary between a feed apparatus that supplies material to the catenary and a take-up apparatus that removes material from the catenary. The apparatus comprises means for illuminating the material in vicinity of the catenary. A plurality of photosensitive devices is arranged in vertical orientation in the region of the catenary. The apparatus includes a first plurality of voltage generators equal in number to the number of photosensitive devices. Each voltage generator is connected to a respective one of the photosensitive devices and is capable of generating a unique voltage which depends upon the vertical position of the photosensitive device that is connected thereto. Motor control means controls the rate at which the take-up apparatus removes material from the catenary. Means is providing for applying to the motor control means a voltage proportional to the voltage generated by the most recently activated voltage generator.

DESCRIPTION OF THE PREFERRED EMBODIMENT

The present invention will be described in relation to apparatus for controlling the depth of sag of a free hanging optical fiber as it is conveyed from a strength testing apparatus to a reel. It will be appreciated that the disclosed apparatus is applicable to controlling the depth of sag of a variety of materials such as filaments, webs or the like which pass between material suply and material take-up devices.

Figure 1:
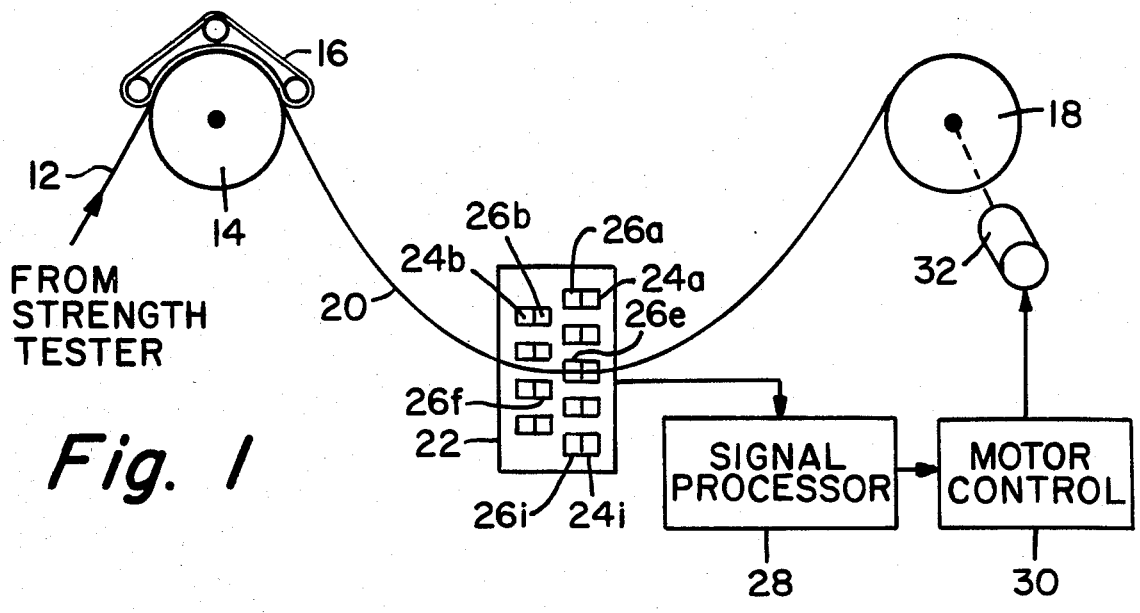
FIG. 1 is a schematic illustration of the catenary controller of the present invention.

In the catenary controller of FIG. 1, an optical fiber 12 passes between a motor driven castan 14 and flexible belt 16, whereby it is conveyed from a strength testing apparatus to a take-up spool 18. Fiber 12 forms a free hanging loop or catenary 20 between capstan 14 and spool 18. It is desirable that fiber 12 be wound on spool 18 at low tension in order to minimize damage to the fiber or coating thereon and to reduce the effect of micro-bending on attenuation and bandwidth measurements that are made on the wound fiber.

Situated at the lowest region of catenary 20 is a bracket or housing 22 for supporting arrays of light emitters **24*a* through 24*i* and photosensitive devices or detectors 26*a* through 26*i*. In the illustrated embodiment there are two staggered arrays of photosensitive devices, each of which has an associated light emitter situated adjacent thereto. In the preferred embodiment, infrared light emitted by one of the emitters 24*a* through 24*i* is reflected from fiber 12 back to the corresponding one of the photosensitive devices 26*a* through 26*i***. The spacings between photosensitive devices in each array is such that, as the catenary moves above or below the photosensitive device in one of the two arrays, it becomes situated adjacent to one of the photosensitive devices in the other of the two arrays.

Detectors **26*a* through 26*i* are connected to a signal processor 28 which generates a voltage that is coupled to motor control circuit 30 which controls the voltage applied to motor 32, thereby determining the speed at which the motor operates. As the location of catenary 20 deviates from its predetermined position, the disclosed system either increases or decreases the speed of motor 32 to restore catenary 20** to the desired position.

Figure 2:
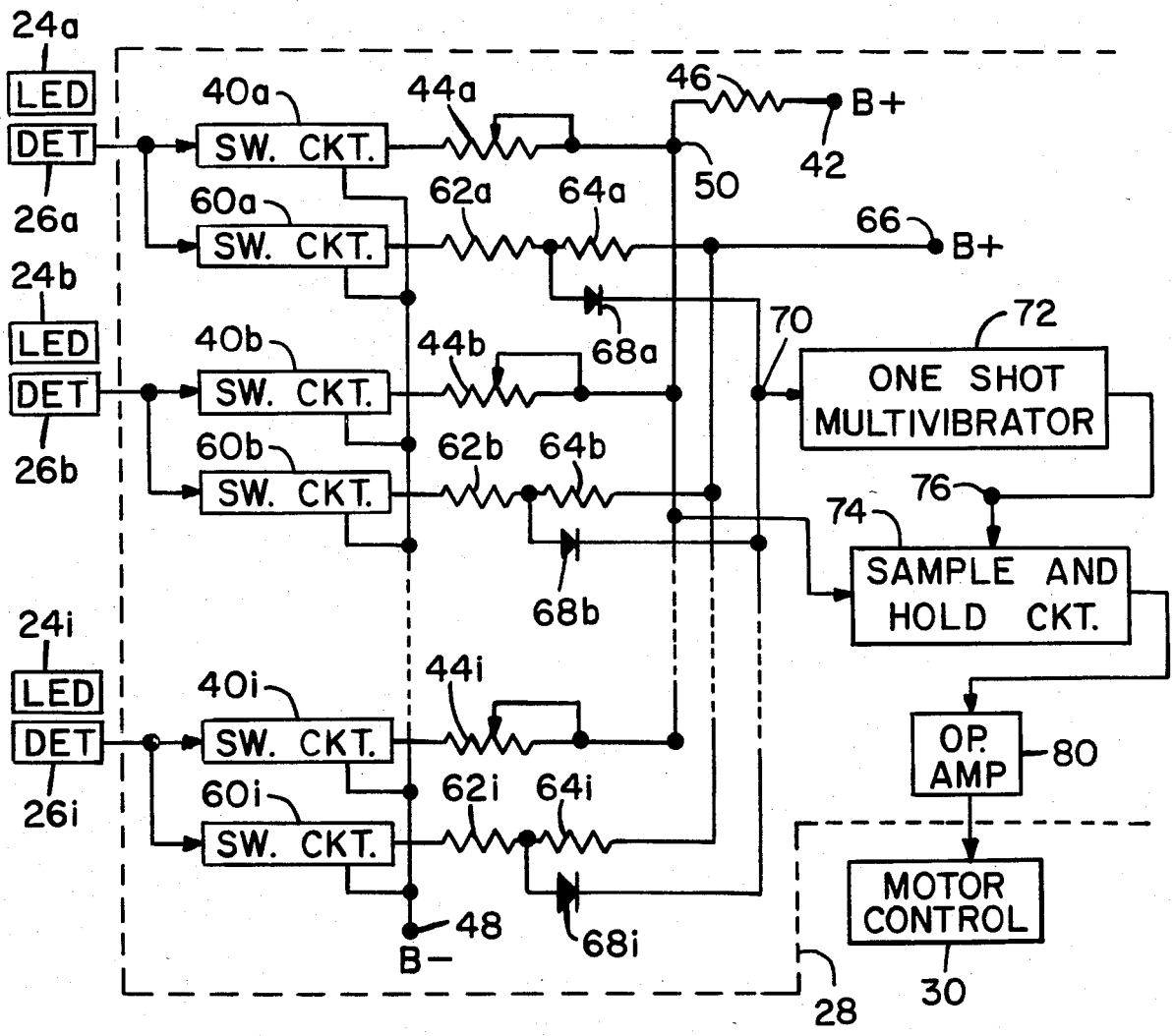
FIG. 2 is a block diagram of the signal processor of FIG. 1.

Referring to FIG. 2 there is shown an electronic circuit for providing the appropriate voltage to motor control circuit 30. Nine detectors, **26*a* through 26*i* were found to be sufficient to control the speed of take-up reel 18 such that the position of catenary 20 is maintained between predetermined limits. FIG. 2 shows only the circuitry associated with detectors 26*a*, 26*b* and 26*i*. Light emitting diodes 24*a*, 24*b* and 24*i*, which are situated adjacent to the detectors 26** are energized by suitable power supplies (not shown).

Detector **26*a* is coupled to the input of switching circuit 40*a*, the output of which is connected to the B+ power supply terminal 42 by an output resistor 44*a* and a common resistor 46. Similarly, detectors 26*b* through 26*i* are connected to switching circuits 40*b* through 40*i*, the outputs of which are connected to resistor 46 by resistors 44*b* through 44*i*. The resistances increase proportionately from resistor 44*a* to resistor 44*i*. Switching circuits 40*a* through 40*i* are normally non-conducting. When a switching circuit such as circuit 40*a* is activated by its associated detector, it connects resistor 44*a* directly to B− terminal 48. Since resistor 44*a* has the smallest resistance of resistors 44*a* through 44*i*, activation of circuit 40*a* causes the generation at terminal 50 of a voltage which is lower than that which would be generated by the activation of any of the other switching circuits 40*b* through 40*i*. Thus, the successive activation of each of the switching circuits 40*b* through 40*i* produces the generation of progressively higher voltages at terminal 50. Switching circuits 24***a* through 24*i* and there associated output resistors 44*a* through 44*i* constitute a first plurality of voltage generators. Common output terminal 50 of switching circuits 40*a* through 40*i* is connected to sample and hold circuit 74.

Detectors 26*a* through 26*i* are also connected to switching circuits 60*a* through 60*i*, respectively. The output of each of the switching circuits 60*a* through 60*i* is connected to B+ voltage through a respective pair of series connected resistors 62*a* through 62*i* and 64*a* through 64*i*. For example, the output terminal of switching circuit 60*a* is connected through resistors 62*a* and 64*a* to B+ terminal 66, the output of switching circuit 60*b* is connected through resistors 62*b* and 64*b* to terminal 66, and so on. The common points between respective pairs of resistors 62*a* through 62*i* and 64*a* through 64*i* are connected by diodes 68*a* through 68*i* to input terminal 70 of a pulse generator such as one-shot multivibrator 72.

When the position of catenary 20 is such that light reflects from fiber 12 to detector 26*e*, signal processor 28 provides a voltage to motor control circuit 30 which in turn supplies motor 32 with a voltage sufficient to drive spool 18 at a rotational rate which is predetermined to be that rate necessary to provide the same average rim speed as capstan 14. If the rim speeds of capstan 14 and spool 18 are equal, the position of catenary 20 will remain constant. However, slight fluctuations in the rim speed of either capstan 14 or spool 18 will cause that portion of catenary 20 in the vincinity of photo detectors 26*a* through 26*a* to change position. For example, if the catenary were to be located adjacent photo detector 26*b*, switching circuit 40*b* would be actuated, thereby connecting one terminal of resistor 44*b* to the B− terminal 48. Each of the remaining switching circuits 40*a* through 40*i* would remain unenergized so that their associated output resistors 44*a* through 44*i* remain disconnected from B− terminal 48. The resultant voltage generated at terminal 50 is connected to an input terminal of sample and hold circuit 74. Circuit 74 functions to continue to provide at the output terminal thereof a voltage which is proportional to that connected to the input terminal thereof at the time that an enable pulse appears at terminal 76 thereof. The appearance of an enable pulse at terminal 76 enables sample and hold circuit 74 to accept the updated input voltage at terminal 50 and to provide at its output terminal a voltage that is proportional to that updated input voltage.

Switching circuits 60*a* through 60*i* are normally conducting. Simultaneous with the activation of switching circuit 40*b*, switching circuit 60*b* is activated by detector 26*b*, the remaining switching circuits 60*a* through 60*i* remaining unactivated. The resultant voltage pulse generated at the terminal between resistors 62*b* and 64*b* is coupled by diode 68*b* to input terminal 70 of multivibrator 72. Switching circuits 60*a* through 60*i* and their associated output resistors 62*a* through 62*i* and 64*a* through 64*i* constitute a second plurality of voltage generators. The second plurality of voltage generators in combination with one-shot multivibrator 72 constitute pulse generator means. Multivibrator 72 provides to enable terminal 76 a short duration output pulse, the leading edge of which is slightly delayed with respect to the pulse generated at the terminal between resistors 62*b* and 64*b*, the voltage at the output terminal of sample and hold circuit 74 changes to one which is proportional to that which appears at the input thereof. The sample and hold circuit output voltage is coupled by an operational amplifier 80 to motor control circuit 30. A relatively low voltage is generated across resistor 44*b* and consequently a relatively low voltage appears at the output of sample and hole circuit 74 until the catenary 20 moves to a position adjacent to a detector different from detector 26*b*. This relatively low voltage is held at the output of sample and hold circuit 74 so that motor control circuit 30 continues to drive reel 18 at a reduced rotational rate, thereby tending to reposition catenary 20 to its predetermined location at the central region of the array of photo diodes 26*a* through 26*i*.

As catenary 20 rises above the predetermined position illustrated in FIG. 1 and assumes a position adjacent to one of the photo diodes 26*a* through 26*d*, signal processor 28 instructs motor control circuit 30 to decrease the rotational rate of reel 18. When catenary 20 assumes a position adjacent to diode 26*d*, processor 28 instructs motor control 30 to make a relatively small adjustment from its predetermined rotational rate. A relatively large adjustment in motor speed is made if catenary 20 reaches a position adjacent to photo detector 26*a*.

As catenary 20 drops to a position lower than that illustrated in FIG. 1 signal processor 28 instructs motor control circuit 30 to increase the rotational rate of motor 32 whereby catenary 20 can be driven upwardly to its predetermined position. When catenary 20 falls to a position adjacent to photo detector 26*f*, processor 28 instructs motor control circuit 30 to make only a slight increase in rotational rate of motor 32 relative to its predetermined rate. If catenary 20 sags to a position adjacent to diode 26*i*, the disclosed circuitry causes a relatively large increase in rotational rate of motor 32.

In summary, the circuit described above allows each of the switching circuits 40*a* through 40*i* to supply a unique voltage to the sample and hold circuit 74. As one of the switching circuits 40*a* through 40*i* is triggered on by the repositioning of catenary 20 to a position adjacent to the associated one of photo detectors 26*a* through 26*i*, the input to the sample and hold circuit is updated with that switch's unique voltage. The simultaneous switching of the associated one of switching circuits 60*a* through 60*i* causes one-shot multivibrator 72 to enable sample and hold circuit 74 whereby it accepts the updated input voltage. The output of the sample and hold module is then employed to control the speed of the wind-up motor. As the catenary drops, the voltage increases, thereby speeding up the motor. If the catenary rises, the voltage applied to the motor decreases and slows the rotational rate of the motor.

I claim:

1. An apparatus for automatically controlling the sag depth of a catenary between a feed apparatus that supplies material to the catenary and a take-up apparatus that removes material from the catenary, comprising a motor for driving said take-up apparatus, means for illuminating said material in the vicinity of said catenary, a plurality of photosensitive devices arranged in vertical orientation in the region of the catenary, a first plurality of voltage generators equal in number to said photosensitive devices, each of said first plurality of voltage generators comprising a switching circuit which is connected to a respective one of said photosensitive devices, and an output resistor, one terminal of which is connected to said switching circuit, the remaining terminal of said output resistor being connected to a power supply by a common output resistor, each said voltage generator being capable of generating a unique voltage which depends upon the vertical position of the photosensitive device connected thereto, motor speed control means connected to said motor for controlling the rate at which said take-up apparatus removes material from said catenary, and means for applying to said motor control means a voltage proportional to the voltage generated by the most recently activated voltage generator.

2. The apparatus of claim 1 wherein said last named means comprises a sample and hold circuit, the signal input terminal of which is connected to each of said first plurality of voltage generators, said sample and hold circuit having an enable input terminal and an output terminal, the voltage appearing at said output terminal being dependent upon the voltage at said input teminal at the time that an enable pulse appears at said enable terminal, and pulse generator means connected to said photo sensitive detectors for providing an enable pulse to said sample and hold enable terminal.

3. Apparatus in accordance with claim 2 wherein said pulse generator means comprises a pulse generator, a second plurality of voltage generators equal in number to said number of photosensitive devices, each of said second plurality of voltage generators being connected to a respective one of said photosensitive devices, and means for connecting the outputs of each of said second plurality of voltage generators to the input terminal of said pulse generator.

4. An apparatus for automatically controlling the sag depth of a catenary between a feed apparatus that supplies material to the catenary and a take-up apparatus that removes material from the catenary, comprising a motor for driving said take-up apparatus, motor speed control means connected to said motor for controlling the rate at which said take-up apparatus removes material from said catenary, means for illuminating said material in the vicinity of said catenary, a plurality of photosensitive devices arranged in a vertically spaced orientation along the distance between the maximum and minimum permisable excursions of the catenary, a first plurality of switching circuits equal in number to said photosensitive devices, each of said first plurality of switching circuits being connected to a respective one of said photosensitive devices, a plurality of output resistors, one terminal of each of said output resistors being connected to a respective one of said first plurality of switching circuits, the remaining terminals of said output resistors being connected to a power supply by a common output resistor, a sample and hold circuit, the signal input temrinal of which is connected to the junction between said plurality of output resistors and said common output resistor, said sample and hold circuit having an enable input terminal and having an output terminal which is connected to said motor speed control means, the voltage appearing at said output terminal being dependent upon the voltage at said signal input terminal at the time that an enable pulse appears at said enable terminal, and pulse generator means connected to said photosensitive detectors for providing an enable pulse to said sample and hold enable terminal.

5. Apparatus in accordance with claim 4 wherein said pulse generator means comprises a pulse generator, a plurality of voltage generators equal in number to said number of photosensitive devices, each of said plurality of voltage generators being connected to a respective one of said photosensitive devices, and means for connecting the outputs of each of said plurality of voltage generators to the input terminal of said pulse generator.

* * * * *